US005204495A

United States Patent [19]

Floyd, Jr. et al.

[11] Patent Number: 5,204,495

[45] Date of Patent: Apr. 20, 1993

[54] DEVELOPER UNIT DISTURBING BRUSH

[75] Inventors: Lawrence Floyd, Jr., Rochester; John F. Knapp, Fairport; Robert E. Trott, Webster; Norman W. Czubaj, Jr., Rochester, all of N.Y.

[73] Assignee: Xerox Corporation, Stamford, Conn.

[21] Appl. No.: 891,064

[22] Filed: Jun. 1, 1992

[51] Int. Cl.[5] ..... G03G 15/08

[52] U.S. Cl. ..... 118/654; 355/255

[58] Field of Search ..... 118/653, 654, 661; 355/259, 255, 245, 296; 15/308, 256.52, 256.53

[56] References Cited

U.S. PATENT DOCUMENTS

| | | | |
|---|---|---|---|
| 3,645,618 | 2/1972 | Lancia et al. . | |
| 3,696,785 | 10/1972 | Andrus . | |
| 4,777,904 | 10/1988 | Gundlach et al. | 118/653 |
| 4,972,230 | 11/1990 | Wayman | 355/246 |
| 5,047,806 | 9/1991 | Brewington et al. | 355/259 |
| 5,077,578 | 12/1991 | Grammatica et al. | 355/259 |
| 5,128,723 | 7/1992 | Bolte et al. | 355/259 |

*Primary Examiner*—R. L. Moses

*Attorney, Agent, or Firm*—H. Fleischer; J. E. Beck; R. Zibelli

[57] ABSTRACT

An apparatus which develops a latent image recorded on an image receiving member with developer material. A donor roll is positioned in a chamber of a housing having a supply of developer material therein. The donor roll transports a metered layer of developer material into contact with the latent image to develop the latent image. A rotating and translating brush gently disturbs the metered layer of developer material on the donor roll. This substantially prevent the accumulation of developer material agglomerates on the donor roll so as to create a more stable, uniform developer material layer for development of the latent image therewith.

14 Claims, 2 Drawing Sheets

DEVELOPER UNIT DISTURBING BRUSH

Figure 1:
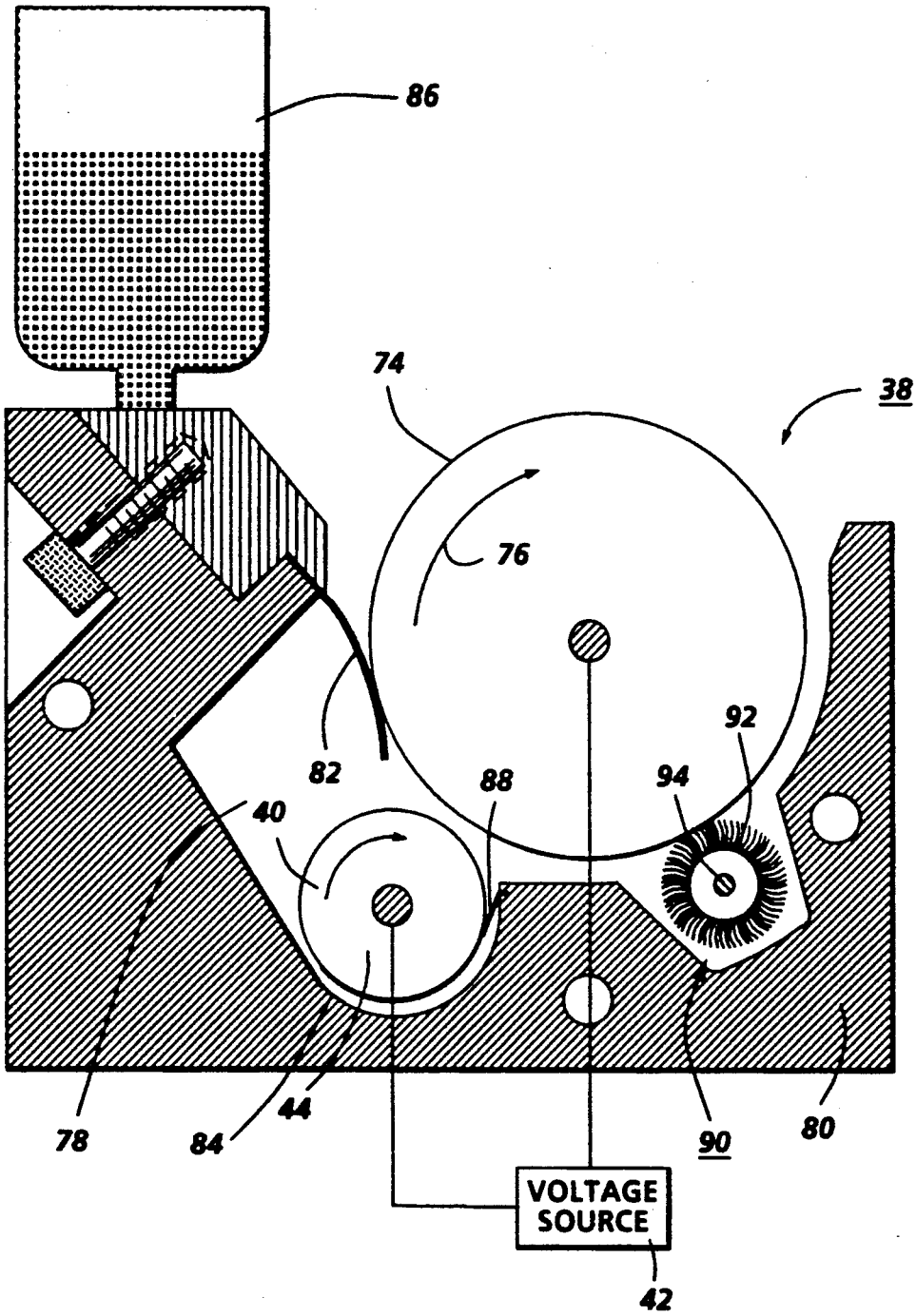

This invention relates generally to an electrophotographic printing machine, and more particularly concerns a development apparatus in which a metered layer of developer material is disturbed to prevent the accumulation of developer material or toner particle agglomerates thereby creating a stable, uniform layer of developer material.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing developer material into contact therewith. This forms a powder image on the photoconductive member which is subsequently transferred to a copy sheet. The copy sheet is heated to permanently affix the developer material in image configuration.

In the foregoing type of printing machine, a development system is utilized to deposit developer material onto the electrostatic latent image recorded on the photoconductive surface. Generally, the developer material comprises toner particles adhering triboelectrically to courser carrier granules. Typically, the toner particles are made from a thermal plastic material while the carrier granules are made from a ferromagnetic material. Alternatively, a single component developer material, e.g. magnetic toner particles, or non-magnetic color toner paticles, may be employed. The developer material is attracted to a donor roll and advanced by the donor roll to the latent image so as to form a powder image on the photoconductive surface. It is necessary to regulate the quantity of developer material being advanced to the development zone adjacent the photoconductive surface. Heretofore, it has been found that it is difficult to maintain a stable, uniform layer of developer material without surface defects on the donor roll when using a stationary metering blade. Recent experimentation has shown that the developer material powder flow, charged characteristics, thruput, and level in the developer unit housing all play significant rolls in producing stable, uniform, excellent developer material layers. Thus, it is highly desirable to be capable of eliminating non-cataststrophic metered developer material defects on the donor roll. Various types of developer units have been devised which may be relevant to the developer unit described herein. The following disclosure appears to contain relevant subject matter:

Co-pending U.S. patent application Ser. No. 428,726
Applicant: Brewington et al.
Filed: Oct. 30, 1989

Co-pending U.S. patent application Ser. No. 428,726 discloses a donor roll positioned in the chamber of a housing storing a supply of developer material therein. The donor roll transports the developer material into contact with the latent image to develop the latent image. A rotating, elongated member fluidizes the developer material. As developer material is discharged from a storage container into the chamber of the developer housing, it exerts pressure on the fluidized developer material to move the developer material from one end of the housing to the other end thereof. An electrical bias is applied between the elongated member and the donor roll so as to attract developer material is attracted to the donor roll. The free end of a metering and charging blade is resiliently urged into contact with the donor roll to regulate the quantity of developer material on the donor roll and to provide a charge therefor.

Pursuant to the features of the present invention, there is provided an apparatus for developing a latent image recorded on an image receiving member. The apparatus includes a housing defining a chamber storing a supply of developer material therein. Means, disposed at least partially in the chamber of housing, transport a metered layer of developer material. Means are provided for disturbing the metered layer of developer material on the transporting means. This prevents the accumulation of developer material agglomerates on the transporting means creating a stable, uniform layer of developer material for developing the latent image recorded on the image receiving member therewith.

In accordance with another aspect of the present invention, there is provided an electrophotographic printing machine of the type having an electrostatic latent image recorded on a photoconductive member. The improvement includes a housing defining a chamber storing a supply of developer material therein. Means, disposed at least partially in the chamber of the housing, transport a metered layer of developer material. Means are provided for disturbing the metered layer of developer material on the transporting means. This prevents accumulation of developer material agglomerates on the transporting means creating a stable, uniform layer of developer material thereon for developing the latent image recorded on the image receiving member therewith.

Figure 2:
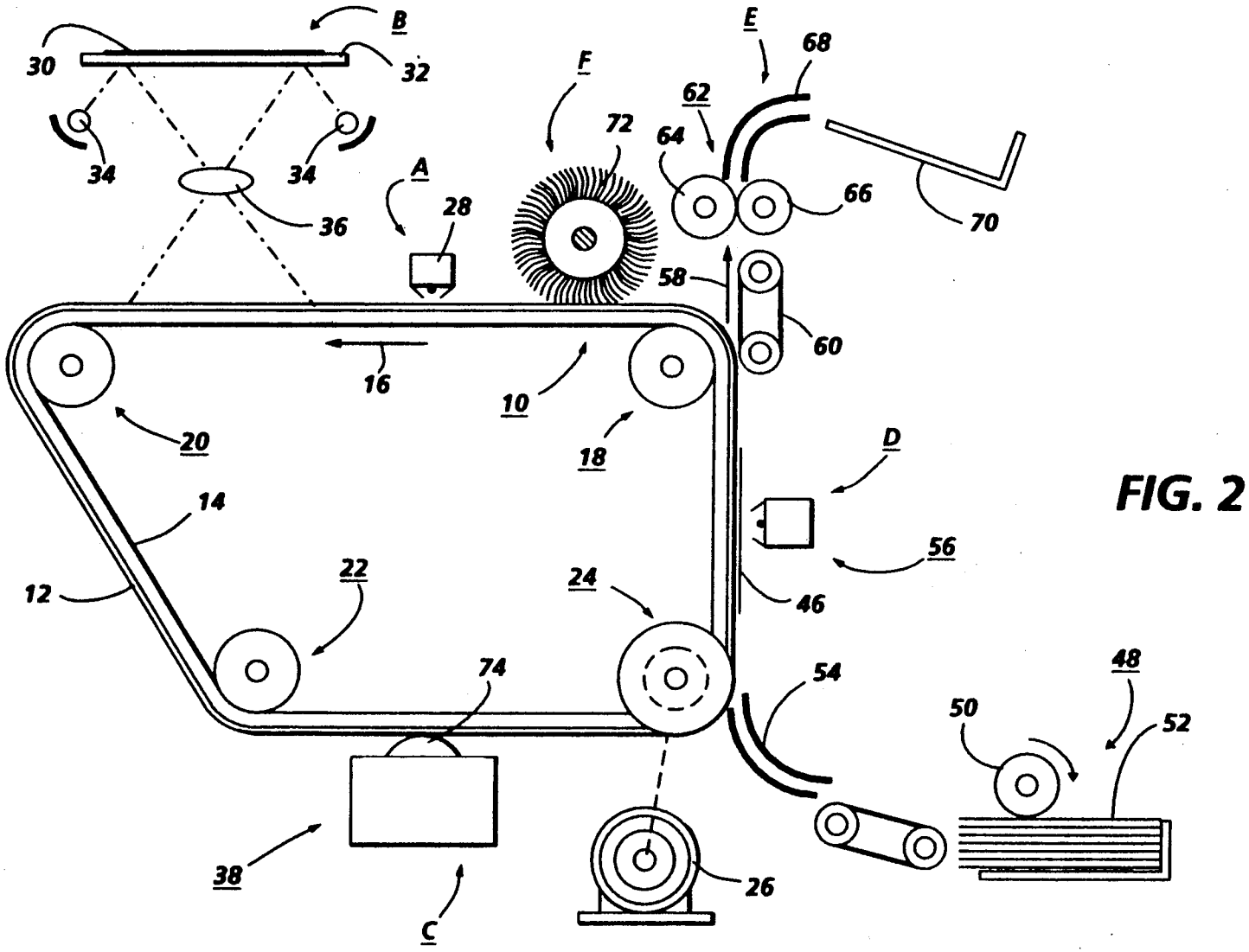

Other aspects of the present invention will become apparent as the following description proceeds and upon reference to the drawings, in which:

FIG. 1 is a schematic elevational view showing a development apparatus of the present invention; and FIG. 2 is a schematic elevational view depicting an electrophotographic printing machine incorporating the FIG. 1 development apparatus therein.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

For a general understanding of the features of the present invention, reference is made to the drawings. In the drawings, like reference numerals have been used throughout to designate identical elements. FIG. 2 schematically depicts the various elements of an illustrative electrophotographic printing machine incorporating the development apparatus of the present invention therein. It will become evident from the following discussion that this development apparatus is equally well suited for use in a wide variety of printing machines and is not necessarily limited in its application to the particular embodiment depicted herein.

Inasmuch as the art of electrophotographic printing is well known, the various processing stations employed in the FIG. 2 printing machine will be shown hereinafter schematically and their operation described briefly with reference thereto.

Turning now to FIG. 2, the electrophotographic printing machine employs a belt 10 having a photoconductive surface 12 deposited on a conductive substrate 14. By way of example, photoconductive surface 12 may be made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20 and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30 disposed upon transparent platen 32. Thereafter, belt 10 advances the electrostatic latent image recorded on photoconductive surface 12 to development station C.

One skilled in the art will appreciate that a Raster Input Scanner (RIS) and a Raster Output Scanner (ROS) may be used instead of the light lens system heretofore described. The RIS contains document illumination lamps, optics, a mechanical scanning mechanism and photosensing elements such as charged couple device (CCD) array. The RIS captures the entire image from the original document and converts it to a series of raster scan lines. These raster scan lines are outputed from the RIS and function as the input to the ROS. The ROS performs the function of creating the output copy of the image and lays out the image in a series of horizontal lines with each line having a specific number of pixels per inch. These lines illuminate the charged portion of the photoconductive surface to selectively discharge the charge thereon. An exemplary ROS has lasers with rotating polygon mirror blocks, solid state modulater bars and mirrors. Still another type of exposure system would merely utilize a ROS with the ROS being controlled by the output from an electronic subsystem (ESS) which prepares and manages the image data flow between a computer and the ROS. The ESS is the control electronics for the ROS and may be a self-contained, dedicated minicomputer.

At development station C, a developer unit, indicated generally by the reference numeral 38, transports a single component developer material of toner particles into contact with the electrostatic latent image recorded on photoconductive surface 12. Toner particles are attracted to the electrostatic latent image forming a toner powder image on photoconductive surface 12 of belt 10 so as to develop the electrostatic latent image. The detailed structure of developer unit 38 will be described hereinafter with reference to FIG. 1.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the uppermost sheet of a stack of sheets 52. Feed roll 50 rotates to advance the uppermost sheet from stack 50 into sheet chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66. Sheet 46 passes between fuser roller 64 and back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fibrous brush 72 in contact with photoconductive surface 12. The pre-clean corona generator nuetralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

It is believed that the foregoing description is sufficient for purposes of the present application to illustrate the general operation of an exemplary electrophotographic printing machine incorporating the features of the present invention therein.

Referring now to FIG. 1, the detailed structure of developer unit 38 is shown thereat. The developer unit includes a donor roll 74. Donor roll 74 may be bare metal such as aluminum. Alternatively, the donor roll may be a metal roller coated with a thick material. By way of example, a polytetrafluoroethylene based resin such as Teflon, a trademark of the Dupont Corporation, or a polyvinyledene fluoride based resin, such as Kynar, a trademark of the Penwault Corporation, may be used to coat the metal roller. This coating acts to assist in charging the particles adhering to the surface thereof. Still another type of donor roll may be made from stainless steel plated by a catayltic generation process and impregnated with Teflon. The surface of the donor roll is roughened from a fraction of a micron to several microns, peak to peak. An electrical bias is applied to the donor roll. The electrical bias applied on the donor roll depends upon the background voltage level of the photoconductive surface, the characteristics of the donor roll, and the spacing between the donor and the photoconductive surface. Donor roll 74 is coupled to a motor which rotates donor roll 74 in the direction of arrow 76. Donor roll 74 is positioned, at least partially in chamber 78 of housing 80. An elongated toner fluidizing member, indicated generally by the reference numeral 44 fluidizes the toner particles. Fluidized toner particles seek their own level under the influence of gravity. Inasmuch as new toner particles are being discharged from container 86 into one end of the chamber 78 of housing 80, the force exerted on the fluidized toner particles by the new toner particles being added at that end moves the toner particles from that end of housing 80 to the other end thereof. Elongated member 44 is located in chamber 78 closely adjacent to an arcuate portion 84 of housing 80. Arcuate portion 84 is closely adjacent to elongated member 44 and wraps about a portion thereof. There is a relatively small gap or space between arcuate portion 84 and a portion of elongated member 44. New toner particles are discharged into one end of chamber 78 from container 86. As elongated member 44 rotates in the direction of arrow 40, toner particles are fluidized. A motor (not shown) rotates elongated member 44 at about 300 revolutions per minute. The force exerted on the fluidized toner particles by the new toner particles being discharged into chamber 78 advances the fluidized toner particles from the end of the chamber in which the new toner particles have been discharged to the other end thereof. The fluidized toner particles being moved are attracted to donor roller 74. Elongated member 44 is made from an electrically conductive material, such as aluminum, such as a plastic material. Voltage source 42 is electrically connected to elongated member 44. An electrical bias ranging from about 250 volts to about 1000 volts is applied between donor roller 74 and elongated member 44. Preferably, an electrical bias from about 500 volts to about 900 volts is applied between donor roller 74 and elongated member 44. Elongated member 44 is spaced from donor roller 74 to define a gap therebetween. This gap may range from about 0.05 centimeters to about 0.15 centimeters. Donor roller 74 rotates in the direction of arrow 76 to move the toner particles attracted thereto into contact with the electrostatic latent image recorded on photoconductive surface 12 of belt 10. As donor roll 74 rotates in the direction of arrow 76, metering blade 82 has the region of the free end thereof resiliently urged into contact with donor roll 74. Metering blade 82 may be made from a metal, silicon rubber, or plastic material. By way of example, metering blade 82 may be made from steel phosphor bronze and ranges from about 0.025 millimeters to about 0.25 millimeters in thickness being a maximum of 25 millimeters wide. The free end of metering blade 82 extends beyond the tangential contact point with donor roll 74 by about 4 millimeters or less. Metering blade 82 is maintained in contact with donor roll 74 at a pressure ranging from about 10 grams per centimeter to about 250 grams per centimeter. The layer of toner particles adhering to donor roll 74 ranges from about 0.1 milligrams per centimeter square to about 2 milligrams per centimeter square of roll surface. In addition to regulating the quantity of toner particles being advanced by donor roll 74, metering blade 82 charges the toner particles to about 20 microcoulombs/gram. By way of example, elongated member 44 may be made from a rod having a cylindrical member mounted thereon. The cylindrical member has a plurality of spaced, saw-toothed shape paddles extending outwardly therefrom. As elongated member 44 rotates, the paddles agitate the fluidized toner particles. The toner particles fly off the tips of the saw-toothed shape paddles so as to be fluidized.

A scraper blade 88 is positioned adjacent elongated member 44 with the free end thereof in contact therewith. In this way, scraper blade 88 removes the excessive developer material from elongated member 44.

Disturbing brush 90 has a multiplicity of fibers 92 extending outwardly therefrom. Disturbing brush 90 includes an elongated shaft 94 mounted in bearings for rotation. Disturbing brush 90 rotates about the elongated axis of shaft 94 with the fibers 92 contacting the layer of developer material on donor roll 74. In addition to rotating, brush 90 translates in a direction substantially parallel to the elongated axis of shaft 94. A combination of rotation and translation may be achieved by coupling brush 92, a motor through a suitable rinematic linkage. The linkage coupling brush 90 with the drive motor (not shown) rotates brush 90 and translates it in a direction substantially parallel to the longitudinal axis of shaft 94. In this way, the fibers 92 gently disturb the layer of developer material on donor roll 74 and prevents the build up of agglomerates. This creates a more stable, uniform developer material layer for development. Fibers 92 extending outwardly from brush 90 are relatively soft. The brush rotates slowly and translates simultaneously causing the fibers in contact with the donor roll after the development nip to disturb the toner layer. In this way, a stable, uniform toner layer substantially devoid of any surface defects normally associated with a stationary metering blade is achieved.

One skilled in the art will appreciated tht electrode wires may be positioned in the development zone adjacent the donor roll. In this embodiment, an AC voltage source electrically biases the electrode wires to detach toner paticles from the donor roll. This forms a toner powder cloud in the development.

In recapitulation, it is clear that the apparatus of the present invention includes a donor roll having a metered layer of developer material thereon. A rotating and translating brush has the fibers thereof in contact with the metered layer of developer material. The simultaneous rotation and translation of the brush fibers contacting the metered layer of developer material prevents the buildup of agglomerates on the donor roll surface. This creates a more stable, uniform developer material layer for development.

It is, therefore, evident that there has been provided in accordance with the present invention, a developer unit that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for developing a latent image recorded on an image receiving member, including:

a housing defining a chamber storing a supply of developer material therein;

means, disposed at least partially in the chamber of said housing, for transporting a metered layer of developer material; and means for disturbing the metered layer of developer material on said transporting means to prevent accumulation of developer material agglomerates on said transporting means creating a substantially stable, uniform layer of developer material thereon for developing the latent image recorded on the receiving member therewith, said disturbing means includes a brush having a multiplicity of fibers extending outwardly therefrom in contact with the metered layer of developer material on said transporting means, said brush being adapted to rotate and translate so as to disturb the metered layer of developer material by gently brushing thereagainst.

2. An apparatus according to claim 1, wherein said brush includes an elongated shaft adapted to rotate around the longitudinal axis thereof and to translate in a direction substantially parallel thereto.

3. An apparatus according to claim 2, wherein said transporting means includes:

a donor roll; and means for metering the developer material being advanced by said donor roll to form a metered layer of developer material on said donor roll.

4. An apparatus according to claim 3, wherein said metering means includes a blade having a free end region thereof resiliently urged into engagement with said donor roll.

5. An apparatus according to claim 4, further including:

means, disposed in the chamber of said housing for fluidizing the developer material; and means for applying an electrical bias between said fluidizing means and said donor roll so as to attract fluidized developer material said donor roll.

6. An apparatus according to claim 5, wherein said fluidizing means includes a rotatably mounted elongated member disposed interiorly of the chamber of said housing.

7. An apparatus according to claim 6, wherein said applying means includes a voltage source electrically coupled to said elongated member to apply an electrical bias between said elongated member and said donor roll.

8. An electrophotographic printing machine of the type having an electrostatic latent image recorded on a photoconductive member, wherein the improvement includes:

a housing defining a chamber storing a supply of developer material therein;

means, disposed at least partially in the chamber of said housing, for transporting a metered layer of developer material;

means for disturbing the metered layer of developer material on said transporting means to prevent accumulation of developer material agglomerates on said transporting means creating a substantially stable, uniform layer of developer material thereon for developing the electrostatic latent image recorded on the photoconductive member therewith, said disturbing means includes the brush having a multiplicity of fibers extending outwardly therefrom in contact with the metered layer of developer material on said transporting means, said brush being adapted to rotate and translate so as to disturb the metered layer of developer material by gently brushing thereagainst.

9. A printing machine according to claim 8, wherein said brush includes an elongated shaft adapted to rotate about the longitudinal axis thereof and to translate in a direction substantially parallel thereto.

10. A printing machine according to claim 9, wherein said transporting means includes:

a donor roll; and means for metering the developer material being advanced by said donor roll to form a metered layer of developer material on said donor roll.

11. A printing machine according to claim 10, wherein said metering means includes a blade having a free end region thereof resiliently urged into engagement with said donor roll.

12. A printing machine according to claim 11, further including:

means, disposed in the chamber of said housing, for fluidizing the developer material; and means for applying an electrical bias between said fluidizing means and said donor roll so as to attract fluidized developer material is to said donor roll.

13. A printing machine according to claim 12, wherein said fluidizing means includes a rotatably mounted elongated member disposed interiorly of the chamber of said housing.

14. A printing machine according to claim 13, wherein said applying means includes a voltage source electrically coupled to said elongated member to apply an electrical bias between said elongated member and said donor roll.

* * * * *